United States Patent [19]

Nishiyama et al.

[11] Patent Number: 5,000,695

[45] Date of Patent: Mar. 19, 1991

[54] FEMALES CONNECTOR CONSTRUCTION FOR USE IN HIGH VOLTAGE CIRCUITS

[75] Inventors: Katsumi Nishiyama; Kiyoyuki Dohnishi, both of Kyoto, Japan

[73] Assignee: Murata Manufacturing Co., Ltd., Japan

[21] Appl. No.: 535,308

[22] Filed: Jun. 7, 1990

Related U.S. Application Data

[63] Continuation of Ser. No. 220,524, Jan. 18, 1988, abandoned.

[30] Foreign Application Priority Data

Jul. 20, 1987 [JP] Japan ..... 62-111736
Jul. 20, 1987 [JP] Japan ..... 62-111737

[51] Int. Cl.[5] ..... H01R 13/52; H01R 13/533

[52] U.S. Cl. ..... 439/276; 439/589; 439/593; 439/606; 439/856

[58] Field of Search ..... 439/592, 593, 276, 279, 439/599, 603, 604, 629, 588, 750, 460, 874, 888, 736, 936, 852, 589, 856

[56] References Cited

U.S. PATENT DOCUMENTS

| | | | |
|---|---|---|---|
| 2,701,867 | 2/1955 | Obenschain et al. | 439/606 |
| 2,991,441 | 7/1961 | Butler et al. | 439/276 |
| 3,609,633 | 9/1971 | Hargett | 439/856 |
| 4,076,369 | 2/1978 | Ostapovitch | 439/852 |
| 4,335,932 | 6/1982 | Herrmann, Jr. | 439/276 |
| 4,679,875 | 7/1987 | Ramsey | 439/276 |
| 4,685,886 | 8/1987 | Denlinger et al. | 439/856 |
| 4,725,242 | 2/1988 | Sonobe et al. | 439/589 |

*Primary Examiner*—Paula A. Bradley
*Attorney, Agent, or Firm*—Ostrolenk, Faber, Gerb & Soffen

[57] ABSTRACT

A female connector to be used in combination with a male connector to make electrical connection in a high voltage circuit. The female connector has a cylindrical case made of insulating material. A holder made of elastic material is inserted into the case and fixed therein. The holder is formed with a cavity which is open at one end, and a female terminal is disposed in this cavity. The female terminal has a plurality of spring strips at one end adapted to elastically hold a male terminal, and a leader portion at the other end. The leader portion is exposed beyond the end of the holder opposite to the open end. The leader portion has a lead wire connected thereto, the lead wire being led out of the case. The open end out of which the lead wire is led is sealed by a sealing member made of insulating resin.

10 Claims, 3 Drawing Sheets

FEMALES CONNECTOR CONSTRUCTION FOR USE IN HIGH VOLTAGE CIRCUITS

This is a continuation of U.S. patent application Ser. No. 07/220,524 filed on July 18, 1988 now abandoned.

BACKGROUND OF THE INVENTION

1. Field of the Invention

This invention relates to a construction for a female connector to be used in combination with a male connector for achieving an electrical connection in a high voltage circuit.

A female connector according to this invention is used in combination with a male connector to be paired therewith, for example, for making connection between a cathode ray tube and a high voltage producing circuit. In this case, for example, the male connector is provided on the cathode ray tube and the female connector on the high voltage producing circuit.

2. Description of the Prior Art

A conventional female connector of particular interest to this invention will now be described with reference to FIGS. 1 through 3.

As shown, a female connector 1 has a female terminal 2 formed by bending a metal plate as in detail shown in FIG. 3. The female terminal 2 has an open end 3 for receiving the male terminal of a male connector (not shown). The opposite side of the female connector to the open end 3 is formed with a leader portion 4. The leader portion 4, as shown in FIG. 1, has an insulated or covered lead wire 5 soldered or otherwise fixed thereto.

The female terminal 2 and lead wire 5 described above are inserted into a mold (not shown) and an insulation resin is injected to form a holder 6. In this molding operation, the holder 6 is formed with a slot 7 at a position opposed to a portion of the female terminal 2. The formation of the slot 7 results in a thin-walled portion 8 positioned between the slot 7 and the female terminal 2 and formed of part of the resin which forms the holder 6. This thin-walled portion 8 allows elastic spreading of the female terminal 2. Such elastic deformation of the female terminal 2 ensures that the male terminal inserted therein positively contacts the female terminal 2.

However, the conventional female connector 1 described above has the following problem to be solved.

For molding the holder 6, injection molding is usually employed. During such injection molding, it has often occurred that under the pressure of the resin being injected the lead wire 5 curves as shown in phantom lines in FIG. 1. As a result, part of the lead wire 5 moves closer to the outer surface of the holder 6, thereby detracting from the voltage-withstanding characteristics of the female connector 1.

Also if the contact between the mold and the female terminal 2 is imperfect when the holder 6 is molded, the resin often enters the female terminal 2. Since the resin entering the female terminal adheres to the inner surface of the female terminal 2, the male terminal often fails to make electric contact with the female terminal 2.

Further, the thin-walled portion 8 has a very small thickness and its mechanical strength is very low. Therefore, it is not easy to form the thin-walled portion 8 with a constant thickness when the holder 6 is molded. Thus, the mechanical strength of the thin-walled portion 8 varies from product to product, leading to a drawback that when the male connector is connected to the female connector 2, the force required to insert the male connector into the female connector varies in value. Further, as a result of the aforesaid variation, when the thickness of the thin-walled portion 8 is insufficient, so is the elasticity of the female terminal 2 acting on the male terminal; thus, the reliability of contact of the female terminal 2 with the male terminal is low. Further, where the mechanical strength of the thin-walled portion 8 is low, it sometimes occurs that thin-walled portion 8 is broken by the insertion of the male terminal into the female terminal 2. In this case, the reliability of contact of the male terminal with the female terminal 2 further decreases.

SUMMARY OF THE INVENTION

Accordingly, an object of the invention is to provide a female connector which prevent the voltage-withstanding characteristics from being degraded even if undesirable curving of the lead wire or the male connector takes place.

Another object of the invention is to provide a female connector having a female terminal capable of making firm contact with a male terminal.

A female connector according to the invention has a longitudinally extending case made of insulating material. This case is in cylindrical form, for example, and hence it has a first inner peripheral surface having a first and a second open end and defining a first, longitudinally extending cavity. A holder is inserted into the first cavity of the case and fixed therein. The holder is made of elastic material and has a second inner peripheral surface defining a second cavity having a third open end at one longitudinal end thereof. The holder is received in the case with its longitudinal direction aligned with the longitudinal direction of the case and with its third open end facing in the same direction as the first open end of the case. The holder holds a female terminal made of electrically conductive material. The female terminal has a plurality of contact strips at one end adapted to elastically hold a male terminal and a leader portion at the other end. The contact strips are disposed in the second cavity in the holder. The leader portion is exposed through the other longitudinal end of the holder. The leader portion of the female terminal has a lead wire connected thereto. This lead wire is led out of the second open end of the case. Further, the second open end of the case is sealed by a sealing member made of insulating resin in such a manner as to allow passage of the lead wire therethrough.

According to this invention, there is hardly any possibility of the lead wire being bent within the case when insulating resin serving as a sealing member is filled into the case, because the filling with the insulating resin does not need to use injection molding, which is usually carried out under a high pressure condition. Also, the use of the case which is made of insulating material prevents the voltage withstanding characteristics from being degraded even if the lead wire is bent. Further, a holder of elastic material is used and the inner peripheral surface of the holder can be contacted with the contact strips of the female terminal; thus, in this case the reliability of contact of the female terminal with the male terminal is increased.

In a preferred embodiment of the invention, the outer peripheral surface of the holder and the inner peripheral surface of the case are adapted to contact each other, and are formed with fitting means comprising raised and recessed portions. Therefore, the holder is securely inhibited from moving longitudinally with respect to the case.

According to another aspect of the invention, the contact strips are formed of a metal plate having springiness. This metal plate is bent along two spaced, longitudinally extending bending lines, whereby the metal strips are provided by those portions of the metal plate which are positioned outside these two bending lines.

According to a further aspect of the invention, the contact strips are formed of a metal plate having springiness and shaped to have a plurality of radially extending legs. The legs are bent at their respective proximal ends to face in the same direction along bending lines each extending in a direction which crosses the longitudinal direction of the case. In this manner, contact strips are provided by the plurality of legs.

These objects and other objects, features, aspects and advantages of the present invention will become more apparent from the following detailed description of embodiments of the present invention when taken in conjunction with the accompanying drawings.

DESCRIPTION OF THE PREFERRED EMBODIMENTS

Figure 1:
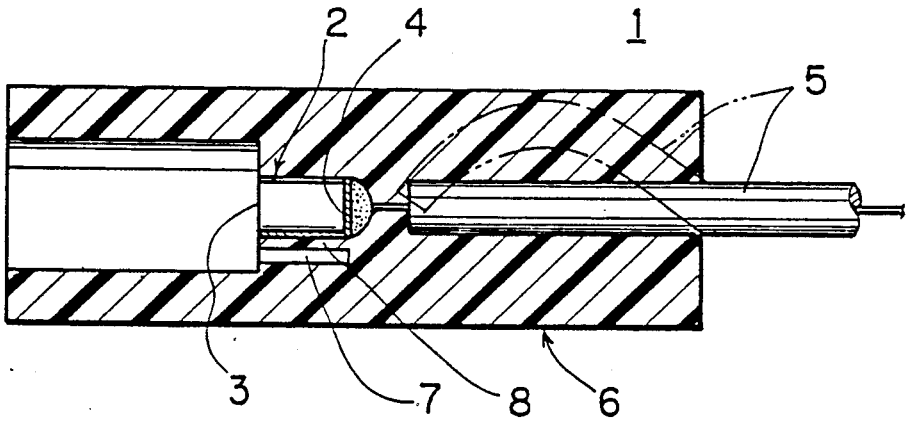
FIG. 1 PRIOR ART
FIG. 1 is a longitudinal sectional view showing a conventional female connector 1.
Figure 2:
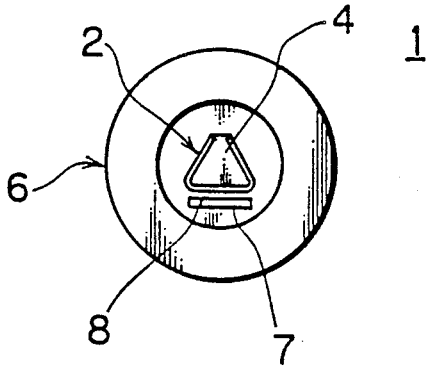
FIG. 2 PRIOR ART
FIG. 2 is a left-hand side view of the female connector 1 shown in FIG. 1.
Figure 3:
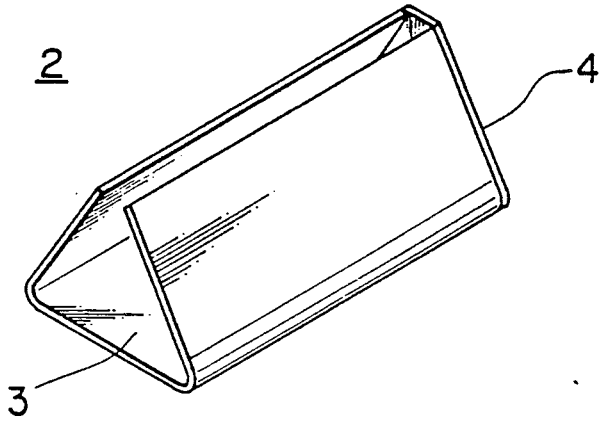
FIG. 3 PRIOR ART
FIG. 3 is a perspective detail view showing a female terminal 2 included in the female connector 1 shown in FIG. 1.
Figure 4:
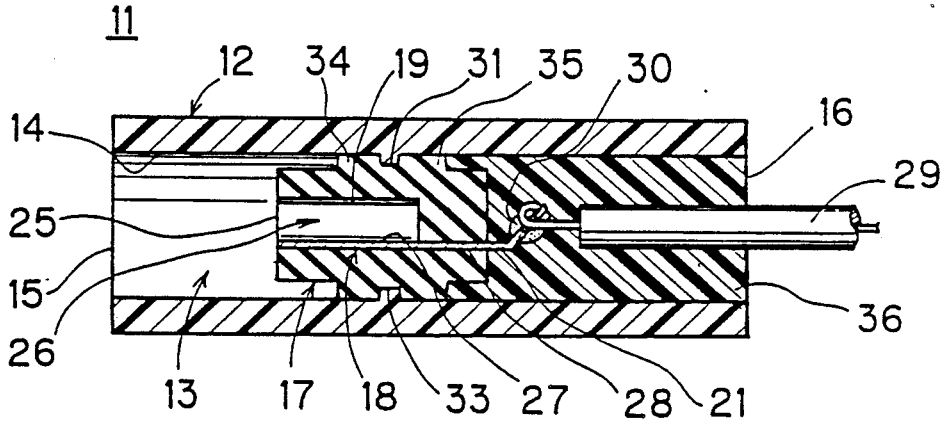
FIG. 4 is a longitudinal sectional view showing a female connector 11 according to an embodiment of the invention.

Referring to FIG. 4, a female connector 11 has a cylindrical case 12 made of insulating resin. The case 12 has an inner peripheral surface 14 defining a longitudinally extending cavity 13. The cavity 13 has first and second open ends 15 and 16.

A holder 17 is inserted into the cavity 13 of the case 12 and fixed therein. The holder 17 serves to hold a female terminal 18.

Figure 5:
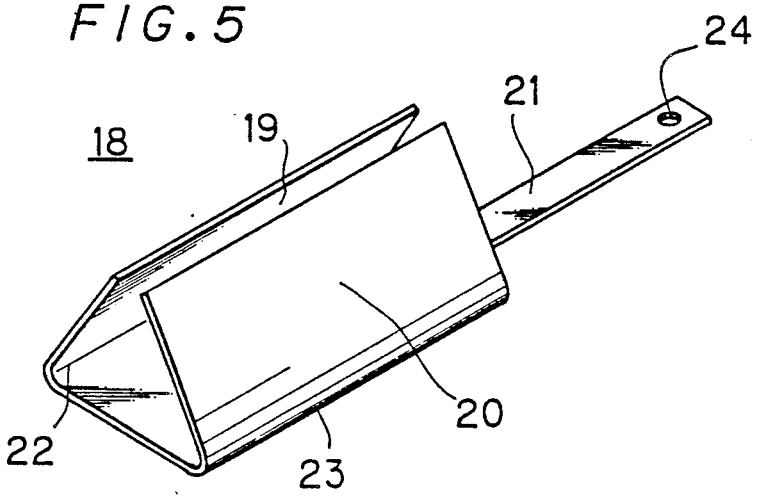
FIG. 5 is a perspective detail view showing a female terminal 18 shown in FIG. 4.

The female terminal 18, as shown in FIG. 5, is integrally formed of a single metal plate having springiness. The female terminal 18 is formed with spring strips 19 and 20 at one end thereof serving as contact strips, and has a lead strip 21 at the other end serving as a leader portion. The spring strips 19 and 20 are provided by those portions of a metal plate forming the female terminal 18 which are positioned outside two spaced bending lines 22 and 23 extending longitudinally of the case 12 when the metal plate is bent along the bending lines 22 and 23. One end of the lead strip 21 is preferably formed with a connection hole 24.

Figure 7:
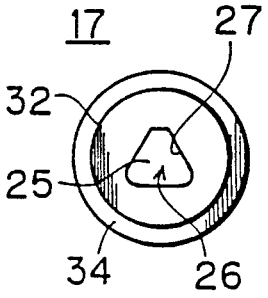
FIG. 7 is a left-hand side view of the holder 17 shown in FIG. 6.
Figure 6:
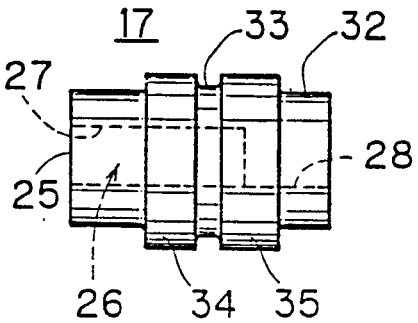
FIG. 6. is a front detail view showing the holder 17 shown in FIG. 4.
Figure 8:
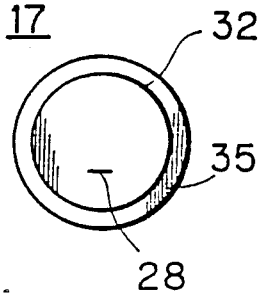
FIG. 8 is a right-hand side view of the holder 17 shown in FIG. 6.

The holder 17 is made of resin or rubber having elasticity. The holder 17, as shown in FIGS. 6 through 8, has an inner peripheral surface 27 defining a cavity 26 having an open end 25 at one longitudinal end thereof. The cross-sectional shape of the inner peripheral surface 27 is preferably correlated with the cross-sectional shape of the end of the female terminal 18 at which the spring strips 19 and 20 are formed. Further, the holder 17 is formed with a slit 28 extending to the end surface on the side opposite to the open end 25 while communicating with the cavity 26. The slit 28 serves to receive the lead strip 21 of the female terminal 18 as the slit 28 is elastically spread.

The female terminal 18 is incorporated into the holder 17 in the following manner; The female terminal 18 is inserted, with the lead strip 21 foremost, into the cavity 26 through the open end 25 of the holder 17. The lead strip 21 is forced into the slit 28 until its front end projects out of the end of the holder 17. At this time, the spring strips 19 and 20 are positioned in the cavity 26 of the holder 17, preferably contacting the inner peripheral surface 27. Further, in order to prevent the female terminal 18 from slipping out of the holder 17, the lead strip 21 may be suitably bent, as shown in FIG. 4.

The lead strip 21 has an insulated or covered lead wire 29 connected thereto. Particularly, this connection is accomplished by engaging the end of the lead wire 29 with the connection hole 24 of the lead strip 21 and then soldering them together as at 30. As for the methods of connecting the lead wire 29 to the lead strip 21, in place of soldering, crimping may be applied by suitably changing the shape of the lead strip 21.

The holder 17 the female terminal 18 therein as described above is inserted into the cavity 13 of the case 12 and fixed therein in such a manner that its longitudinal direction is aligned with the longitudinal direction of the case 12 and its open end 25 faces in the same direction as the first open end 15 of the case 12. In this embodiment, the inner peripheral surface 14 of the case 12 is formed with a circumferentially extending raised portion 31. On the other hand, the outer peripheral surface 32 of the holder 17 is formed with two circumferentially extending parallel raised portions 34 and 35 defining a recessed portion 33 therebetween which fits on the raised portion 31. Therefore, when the holder 17 is inserted into the cavity 13 of the case 12, the longitudinal movement of the holder 17 relative to the case 12 is securely inhibited. Alternatively, without using such combination of raised portion 31 and recessed portion 33, the holder 17 could be fixed to the case 12 by simply pressing the outer peripheral surface 32 of the holder 17 against the inner peripheral surface 14 of the case 12.

In addition, the aforesaid step of connecting the lead wire 29 to the lead strip 21 could be performed after the holder 17 has been incorporated into the case 12.

As shown in FIG. 4, the lead wire 29 is led out of the second open end 16 of the case 12. The seal the second open end 16 of the case 12 while allowing such leadingout of the lead wire 29, a sealing member 36 made of insulating resin such as epoxy resin is filled into that portion of the cavity 13 of the case 12 which is defined between the inner peripheral surface 14 and one end of the holder 17.

In using a female connector 11 thus produced, an unillustrated male connector is inserted through the open end 15 of the case 12 so that its male terminal is elastically held between the spring strips 18 and 20 of the female terminal 18.

FIGS. 9 through 14 show another embodiment of the invention. As compared with the embodiment shown in FIGS. 4 through 8 described above, this embodiment substantially differs therefrom in that the shape of the female terminal is changed.

Figure 9:
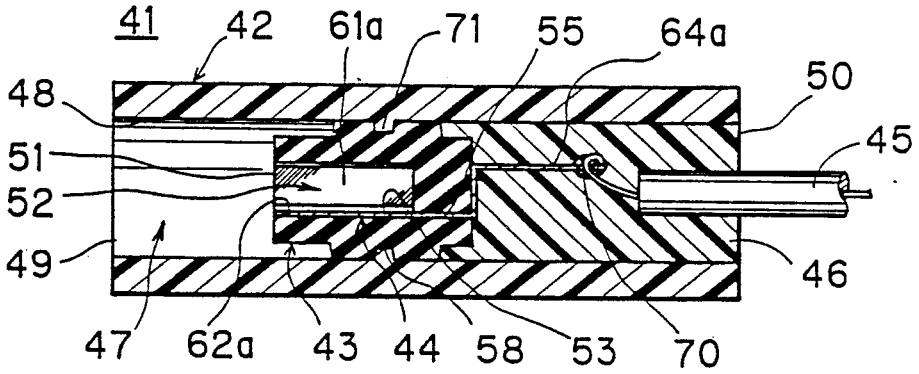
FIG. 9 is a longitudinal sectional view of a female connector 44 according to another embodiment of the invention.

As shown in FIG. 9, a female connector 41, like the female connector 11 described above, has a case 42, a holder 43, a female terminal 44, a lead wire 45 and a sealing member 46.

The case 42 is of substantially the same construction as said case 12, is made of insulating material an dhas an inner peripheral surface 48 defining a longitudinally extending cavity 47. The cavity 47 has first and second open ends 49 and 50. Further, the inner peripheral surface 48 is provided with a circumferentially extending raised portion 71.

Figure 14:
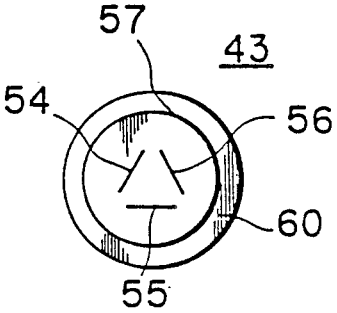
FIG. 14 is a right-hand side view of the holder 43 shown in FIG. 12.

The holder 43, like the holder 17 described above, has an inner peripheral surface 53 defining a cavity 52 having an open end 51 at one longitudinal end thereof. As best shown in FIG. 14 end surface of the holder 43 opposite to its open end 51 is formed with slits 54, 55 and 56 communicating with the cavity 52. Further, the outer peripheral surface 57 of the holder 43 is formed with two raised portions 59 and 60 (FIG. 12) providing a circumferentially extending recessed portion 58 adapted to fit on the raised portion 71, as in the case of the holder 17 described above.

Figure 11:
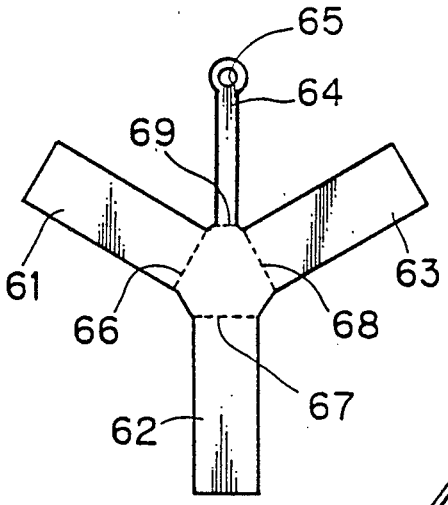
FIG. 11 is a developed view of a metal plate prepared in order to obtain the female terminal 44 shown in FIG. 10.
Figure 10:
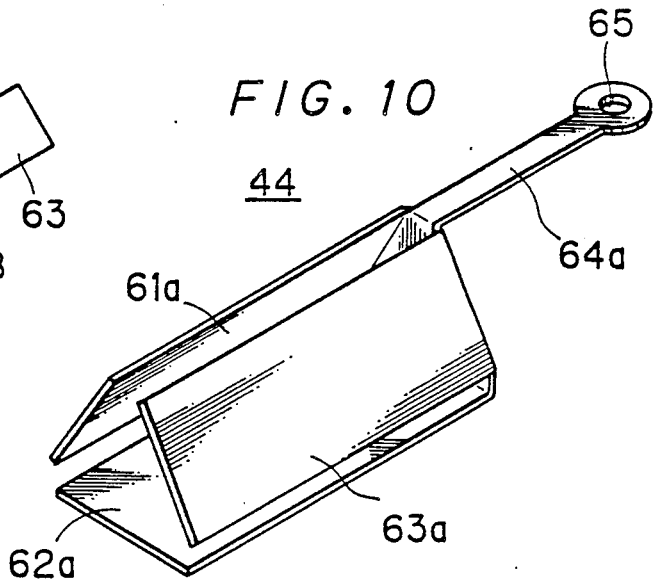
FIG. 10 is a perspective detail view showing a female terminal 44 shown in FIG. 9.
Figure 13:
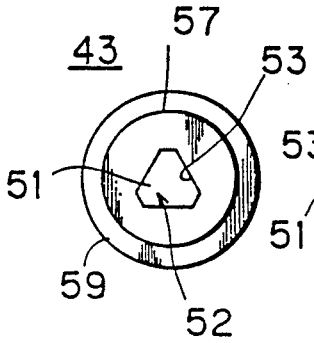
FIG. 13 is a left-hand side view of the holder 43 shown in FIG. 12.
Figure 12:
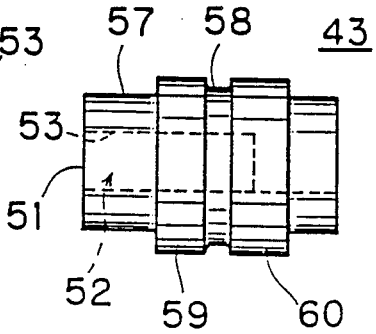
FIG. 12 is a front detail view showing the holder 43 shown in FIG. 9.

The female terminal 44 is obtained by bending a metal plate having a developed form as shown in FIG. 11. This metal plate has a suitable degree of springiness and has a plurality of radially extending legs 61, 62, 63 and 64. Of these legs 61 through 64, the legs 61, 62, 63 and 64. Of these legs 61 through 64, the legs 61, 62 and 63 are to serve as spring strips 61*a*, 62*a* and 63*a*, respectively, the remaining leg 64 being to serve as a lead strip 64*a*, as shown in FIG. 10. One end of the lead strip 64*a* is formed with a connection hole 65.

To obtain the female terminal 44 shown in FIG. 10 by bending the metal plate shown in FIG. 11, the legs 61 through 64 are bent along bending lines 66 through 69 positioned at their respective proximal ends. More particularly, the legs 61, 62 and 63 to serve as spring strips 61 through 64 are bent along bending lines 66 through 69 positioned at their respective proximal ends. More particularly, the legs 61, 62 an 63 to serve as spring strips 61*a*, 62*a* and 63*a* are bent along the bending lines 66, 67 and 68 so that they point in the same direction. On the other hand, the leg 64 to serve as the lead strip 64*a* is bent along the bending line 69 so that it points substantially in the opposite direction. These bending lines 66 through 69 extend each in a direction which crosses the longitudinal direction of the case 42.

The female terminal 44 obtained in the manner described above is incorporated into the holder 43 in the following manner: The female terminal 44 is inserted into the holder 43 with the spring strips 61*a*, 62*a* and 63*a* foremost for insertion into the corresponding slits 54, 55 and 56. At the end of this insertion, the spring strips 61*a* through 63*a* are disposed preferably in contact with the inner peripheral surface 53 of the holder 43, as shown in FIG. 9. Further, the lead strip 64*a* projects out of one end of the holder 43.

The lead strip 64*a* has the lead wire 45 connected thereto. This method of connection is the same as in the embodiment described above; the end of the lead wire 45 is engaged with the connection hole 65 and soldering is applied thereto as at 70.

Finally, a sealing member 46 made of insulating resin is filled into the cavity 47 through the second open end 50 of the case 42.

In the female connector 41 constructed in the manner described above, the effective length of the spring strips 61*a* through 63*a* affecting their springiness can be made greater than in the case of the spring strips 19 and 20 in the preceding embodiment. That is, the effective length contributing to the springiness of the spring strips 19 and 20 of the first embodiment is limited by the diameter of the male terminal to be received in the female terminal 18 and cannot be made so great; however, concerning the spring strips 61*a* through 63*a*in this embodiment, since the effective length affecting the springiness appears in the longitudinal direction, the effective length can be easily increased by increasing the length of the legs 61 through 63 shown in FIG. 11. Therefore, even if male terminals to be received in the female terminal 44 vary in diameter, changes in the spreading angle of the spring strips 61*a* through 63*a* resulting from such variation are small and so is the variation in the spring force of the spring strips 61*a* through 63*a* acting on the male terminal. Therefore, the spring strips 61*a* through 63*a* can be maintained in stabilized contact with the male terminal.

Further, according to the embodiment shown in FIG. 9, the female terminal 44 is made unable to move in either direction by means of the holder 43 and sealing member 46. Therefore, the female terminal 44 can be reliably positioned in the case 42.

In addition, the shape of the female terminal 44 used in the embodiment shown in FIG. 9 is not limited to what is shown in FIG. 10. For example, the number of spring strips maybe 2 or 4 or more. Further, the lead strip 64*a* provided on the female terminal 44 to serve as a leader portion may be dispensed with. In that case, the lead wire 45 will be directly soldered to a region exposed from the end of the holder 43, that is, a region surrounded by the bending lines 66 through 68. In other words, the above region per se serves as a leader portion.

In each of the embodiments described above, the lead wire 29 or 45 has been led out of the case 12 or 42 axially thereof; however, the direction in which the lead wire is led out is arbitrary. For example, an open end corresponding to the second open end 16 or 50 of the case 12 or 42 may be positioned in the lateral portion of the case to withdraw the lad wire in a direction which crosses the axis of the case.

Further, a bushing may be added to that portion of the lead wire 29 or 45 which is led out of the case 12 or 45.

Although the present invention has been described and illustrated in detail in connection with embodiments thereof, it is clearly understood that the same is by way of illustration and example only and is not to be taken by way of limitation, the scope of the present invention being limited only by the terms of the appended claims.

What is claimed is:

1. A female connector which is capable of being used in high-voltage circuits, comprising:

case means extending in a longitudinal direction and made of insulating material, said case means having a first inner peripheral surface having first and second open ends and defining a first cavity extending in said longitudinal direction;

holder means extending in a longitudinal direction and made of an elastic insulating material, said holder means having a second inner peripheral surface defining a second cavity having a third open end at one longitudinal end thereof, said holder means having an outer peripheral surface and being inserted into the first cavity with said outer peripheral surface in contact with said first inner peripheral surface of said case means, and fixed therein with respect to said longitudinal direction, and aligned with said longitudinal direction of said case means and with said third open end facing in the same direction as said first open end;

female terminal means made of electrically conductive material, said female terminal means having a plurality of contact strips at one end thereof adapted to elastically hold a male terminal, and a leader portion at the other end, said contact strips being disposed in said second cavity of said holder means and contacting said second inner peripheral surface of said holder means, said leader portion being exposed beyond the other longitudinal end of said holder means;

said elastic insulating material of said holder means providing high-voltage-withstanding insulation surrounding said contact strips and said leader portion of said female terminal means;

lead wire means connected to said leader portion and led out of said second open end of said case means; and a sealing member made of insulating resin filled into a portion of the first cavity of the case means which is defined between said first inner peripheral surface and said other longitudinal end of said holder means, thereby sealing and retaining the leader portion, the lead wire means, and the connection between the same and providing high-voltage-withstanding insulation for the same, and sealing said second open end of said case means while allowing passage of said lead wire means therethrough.

2. A female connector as set forth in claim 1, wherein said outer peripheral surface of said holder means and said first inner peripheral surface of said holder means are formed with fitting means comprising a combination of mutually engageable raised and recessed portions, whereby the movement of said holder means in said longitudinal direction relative to said case means is inhibited.

3. A female connector as set forth in claim 1 wherein said female terminal means has said contact strips and said leader portion integrally formed thereon.

4. A female connector as set forth in claim 1, wherein said leader portion includes a lead strip projecting from said other longitudinal end of said holder means.

5. A female connector as set forth in claim 1, wherein said holder means is enclosed entirely within said first cavity of said case means.

6. A female connector as set forth in claim 1, wherein said second inner peripheral surface of said holder means made of elastic material cooperates with said contact strips to elastically hold a male terminal.

7. A female connector as set forth in claim 1, wherein said contact strips are formed of a metal plate having springiness by bending said metal plate along at least one bending line extending in said longitudinal direction.

8. A female connector as set forth in claim 7 wherein said metal plate is bent along two spaced bending lines extending in said longitudinal direction, whereby said contact strips are provided by the portions positioned outside said two bending lines.

9. A female connector as set forth in claim 1, wherein said contact strips are formed of a metal plate having springiness by bending said metal plate to an approximately orthogonal degree along at least one bending line extending in a direction which crosses said longitudinal direction.

10. A female connector as set forth in claim 9, wherein said metal plate is shaped to have a plurality of radially extending legs, which are bent at their respective proximal ends along bending lines extending each in a direction which crosses said longitudinal direction so that they point in the same direction, whereby said contact strips are provided by said plurality of legs.

* * * * *